US008866684B2

(12) United States Patent
Jaffri et al.

(10) Patent No.: US 8,866,684 B2
(45) Date of Patent: Oct. 21, 2014

(54) REFLECTOR-BACKED RFID SLOT ANTENNA WITH A COSECANT-SQUARED-LIKE RADIATION PATTERN

(75) Inventors: Rehan K. Jaffri, New York, NY (US); Richard T. Knadle, Dix Hills, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 326 days.

(21) Appl. No.: 13/407,089

(22) Filed: Feb. 28, 2012

(65) Prior Publication Data

US 2013/0222113 A1 Aug. 29, 2013

(51) Int. Cl.
*H01Q 13/10* (2006.01)

(52) U.S. Cl.
USPC ..... 343/767

(58) Field of Classification Search
CPC ..... H01Q 13/18; H01Q 13/10
USPC ..... 343/767
See application file for complete search history.

(56) References Cited

U.S. PATENT DOCUMENTS

| | | | | |
|---|---|---|---|---|
| 4,371,876 | A * | 2/1983 | Nash | 343/768 |
| 6,501,965 | B1 | 12/2002 | Lucidarme | |
| 2003/0076259 | A1 | 4/2003 | Zhang | |
| 2011/0193759 | A1 | 8/2011 | You | |

OTHER PUBLICATIONS

International Search Report and Written Opinion in counterpart application PCT/US2013/025554 mailed May 24, 2013.
"Cosecant-Squared Pattern" definition from www.Answers.com/topic/cosecant-squared-pattern#ixzz1ZHRm6YZk—Answers Corporation.
"Antenna With Cosecant Squared Pattern"—Publisher: Christian Wolff; Radar Basics—Radartutorial.eu—www.radartutorial.eu/06.antennas/an12.en.html.

* cited by examiner

*Primary Examiner* — Graham Smith
(74) *Attorney, Agent, or Firm* — Brian M. Mancini

(57) ABSTRACT

An antenna method and apparatus includes a slot antenna configured within a ground plane and a conductive reflector backing the slot antenna and configured to reflect RF energy. The slot antenna, ground plane, and the reflector cooperatively form a reflector-backed slot antenna and a radial-mode waveguide providing an inverse, mirrored, substantially cosecant-squared radiation pattern.

13 Claims, 7 Drawing Sheets

REFLECTOR-BACKED RFID SLOT ANTENNA WITH A COSECANT-SQUARED-LIKE RADIATION PATTERN

FIELD OF THE DISCLOSURE

The present disclosure relates generally to wireless antennas and more particularly to a reflector-backed Radio Frequency Identification (RFID) slot antenna approaching a cosecant-squared radiation pattern.

BACKGROUND

Radio Frequency Identification (RFID) is utilized in a variety of applications with RFID readers communicating with RFID tags for purposes of identification, location, tracking, and the like. In an exemplary RFID application, an RFID reader may be mounted overhead (e.g., ceiling mounted) relative to a plurality of RFID tags, such as in a retail environment, a warehouse environment, etc. The overhead configuration offers several advantages such as fewer physical obstructions, ease of access to wiring in a ceiling, tamper resistance, safety, and the like. Conventional antenna configurations may be utilized in overhead configurations but these conventional configurations have disadvantages.

For example, RFID ceiling reader antennas can be oriented in one of three ways—parallel, normal, or angular to the ceiling. In the parallel mounted configuration (e.g. slot antennas) or the normal configuration (e.g. dipole antennas) the peak gain is at bore sight, with the main lobe of the antenna radiation directed straight down to the floor/ground. In the angular mounted configuration (e.g. patch antennas, loop antennas, etc), the angle of mount is selected to get some control of the radiation pattern and direct the main radiation lobe to the target of interest. A problem in the above scenarios is that, as we move away from the peaking angle of the main lobe of the radiation pattern, the gain of the antenna begins to drop, ending up in minimal gain at an antenna null point. For RFID applications this null situation results in a requirement to install multiple RFID readers with antennas aimed at various angles to get a consistent and a high percentage RFID read coverage. However, the use of multiple readers not only drives the installation cost up but also does not result in a high percentage of correct tag reads in areas where the antenna gain falls from its peak.

Accordingly, there is a need for an RFID antenna apparatus and method overcoming the aforementioned limitations by minimizing the number of RFID reader systems (especially ceiling mounted) installed in a particular environment, while maintaining/increasing overall read accuracy and correct read percentages. It would also be beneficial to use optimized power (i.e. a high-gain/low power reader combination and vice versa, while reducing cost by utilizing an optimal number of RFID readers at that optimal power.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
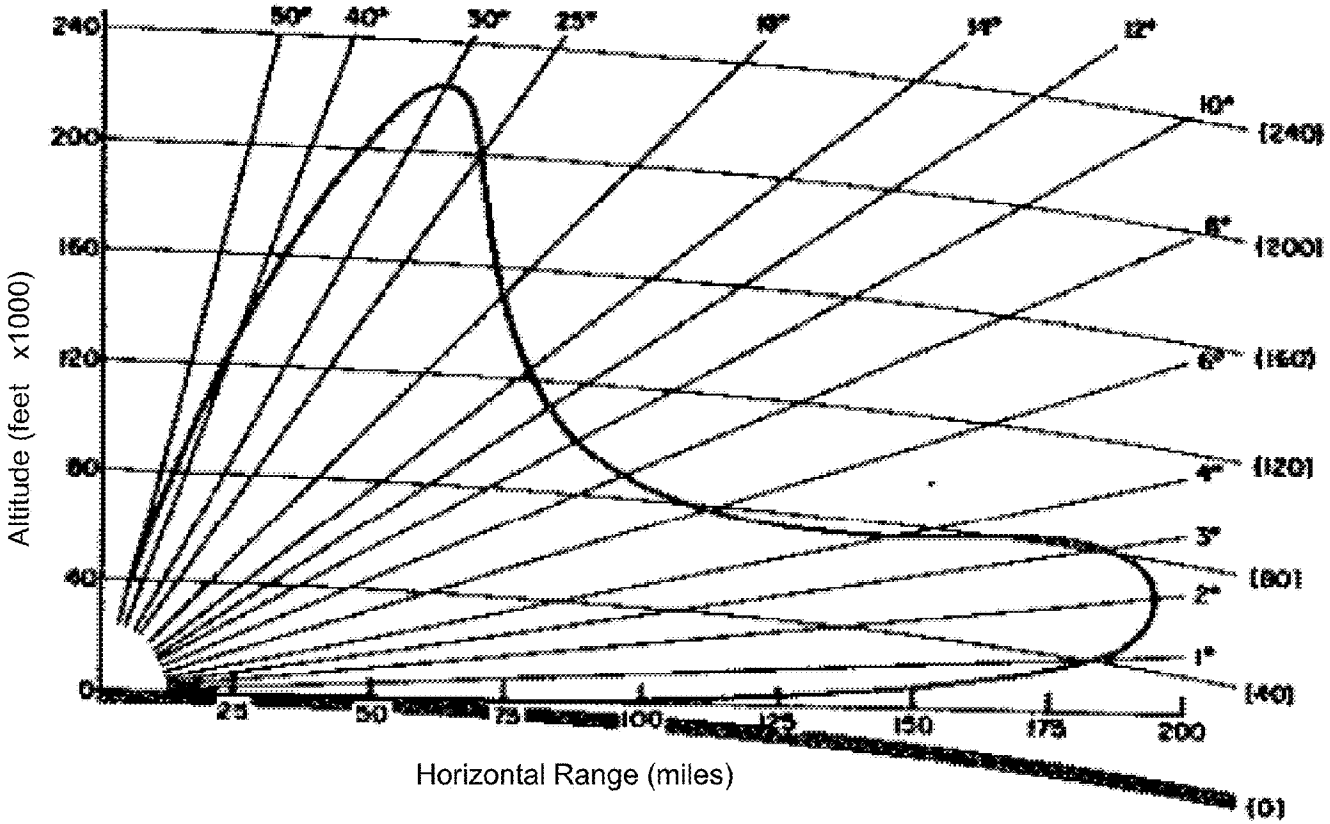
FIG. 1 is a graphical representation of a cosecant-squared antenna radiation pattern.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

In various exemplary embodiments, the present invention provides a Radio Frequency Identification (RFID) antenna apparatus and method that minimizing the number of RFID reader systems (especially ceiling mounted) installed in a particular environment, while maintaining/increasing overall read accuracy and correct read percentages. The present invention also provides a solution to use optimized power (i.e. a high-gain/low power reader combination and vice versa), while reducing cost by utilizing an optimal number of RFID readers at that optimal power.

Typically, RFID is a passive technology where a human operator can read tags affixed to objects presented to the operator using a hand-held reader. Alternatively, objects can be passed in proximity to a fixed RFID reader such that the object tags can be read. However, ceiling-mounted RFID readers that passively read RFID tags is a logical next step of this technology's evolution. Overhead RFID readers do not require human operation. However, the configuration of such readers requires an antenna with high gain, which can read tags at various locations and distances within the read environment. High gain (e.g., ~6 dB) is needed to maximize read range while keeping required power relatively low. In addition, the physical size of the reader needs to be kept to a minimum so that the system is unobtrusive, easy to integrate, and can allow for other features, such as a security camera, access point electronics, etc. The present invention provides such features using an antenna configuration providing a substantially cosecant-squared radiation pattern.

FIG. 1 illustrates a cosecant-squared radiation pattern, which is typically applied to ground-based radar systems, and can be found on page 15.70 of Skolnik, Merrill; "Radar Handbook", $2^{nd}$ Ed. An electromagnetic cosecant-squared radiation pattern is typically referenced as a ground radar-antenna radiation pattern that sends less power to nearby objects than to those farther away in the same sector. In particular, the field intensity varies as the square of the cosecant of the elevation angle. Cosecant-squared antenna patterns (such as shown in FIG. 1) have been used widely in radar applications mainly for air surveillance. Ordinarily such systems are very large, complicated, and expensive. In practice, a cosecant-squared radiation pattern can be achieved by either a specific deformation of a parabolic reflector, or by a stacked beam provided by a series of horns feeding a parabolic reflector. The cosecant-squared pattern approach has not been used for RFID applications. However, the present invention achieves a substantially cosecant-squared radiation pattern using a compact low-cost structure for use in an RFID application utilizing a modified slot antenna.

Figure 2:
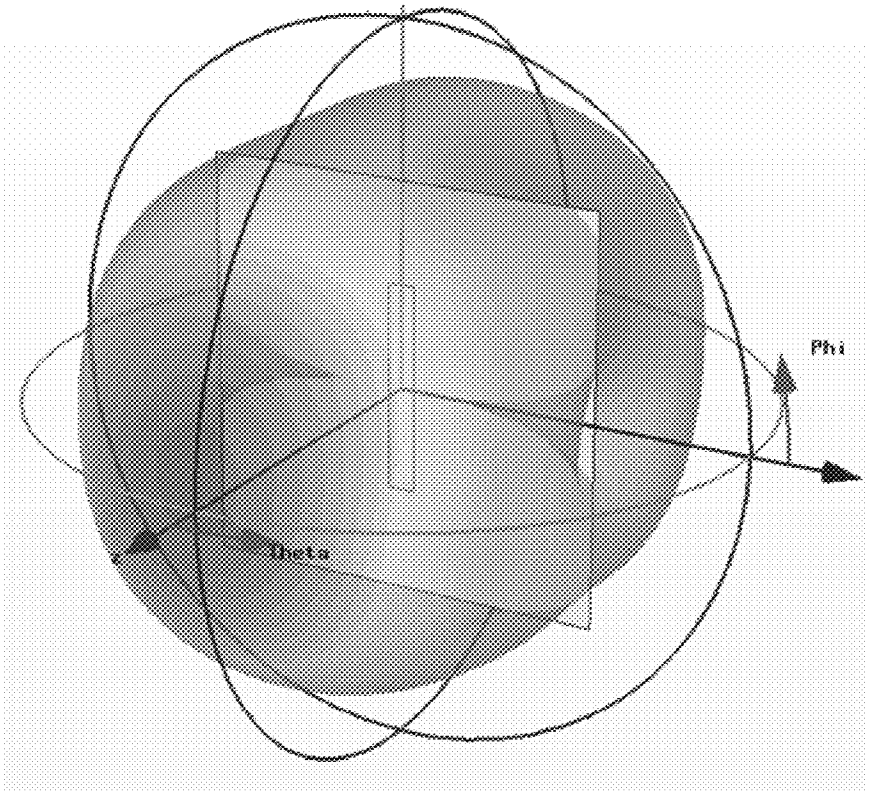
FIG. 2 is a perspective view of a RFID slot antenna and an associated three-dimensional plot of its radiation pattern.
Figure 2:
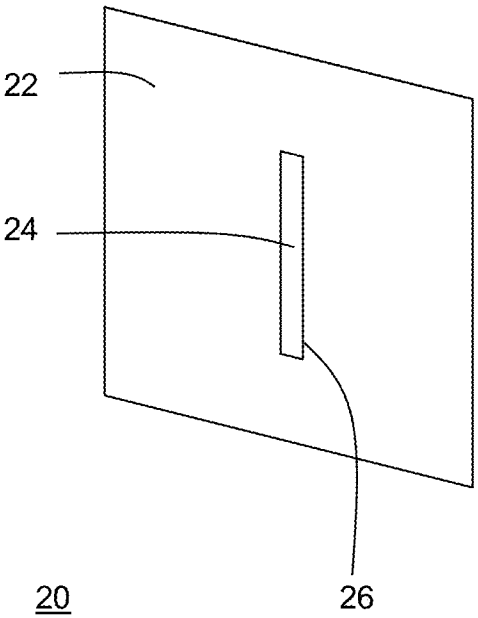

Referring to FIG. 2, a standard slot antenna 20 includes an aperture 24 within a ground plane 22, wherein the aperture, or slot, is coupled to a feed 26 fed by an RF signal at a specific point. It should be recognized that various other feed point locations could be used, in the present invention. This slot antenna has a radiation pattern, as shown, which looks like a toroid or doughnut-shape (similar to a dipole antenna pattern but with reversed E and H fields). This pattern can be manipulated to approach a cosecant-squared-like pattern by increasing the size of the ground plane of the slot antenna well beyond a wavelength of the resonant frequency of the slot antenna, along with the addition of a reflector.

Figure 3:
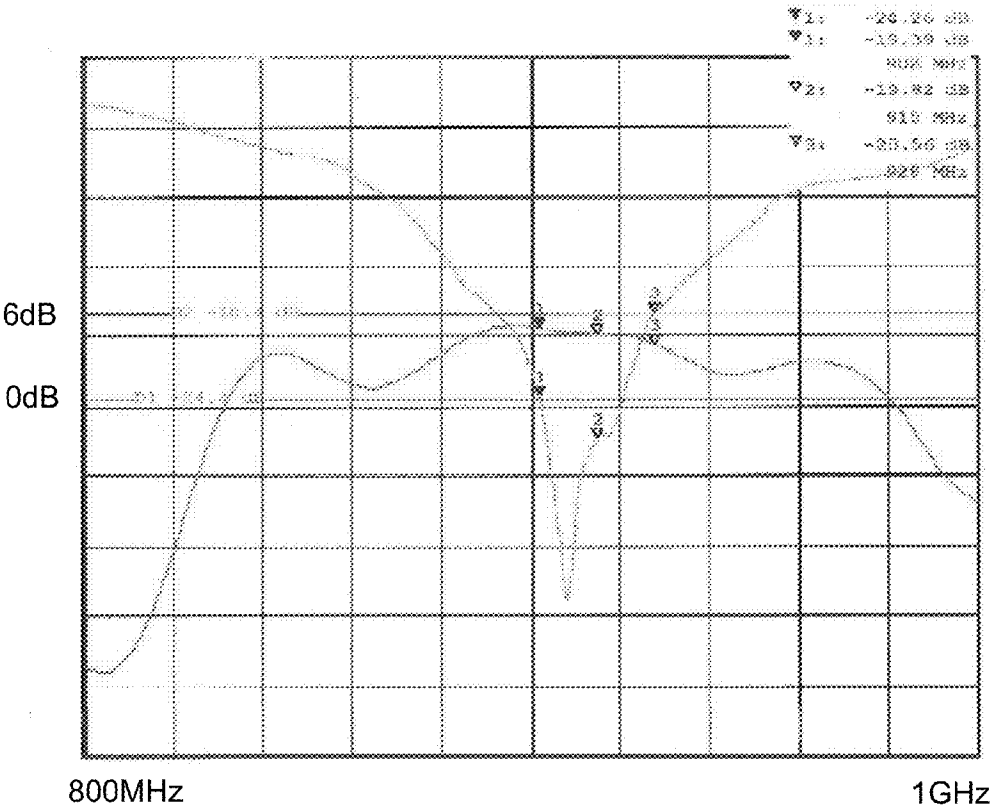
FIG. 3 is a perspective view of an extended ground plane RFID slot antenna with an associated three-dimensional plot of its radiation pattern, and an associated graphical representation of its frequency response, in accordance with some embodiments of the present invention.
Figure 3:
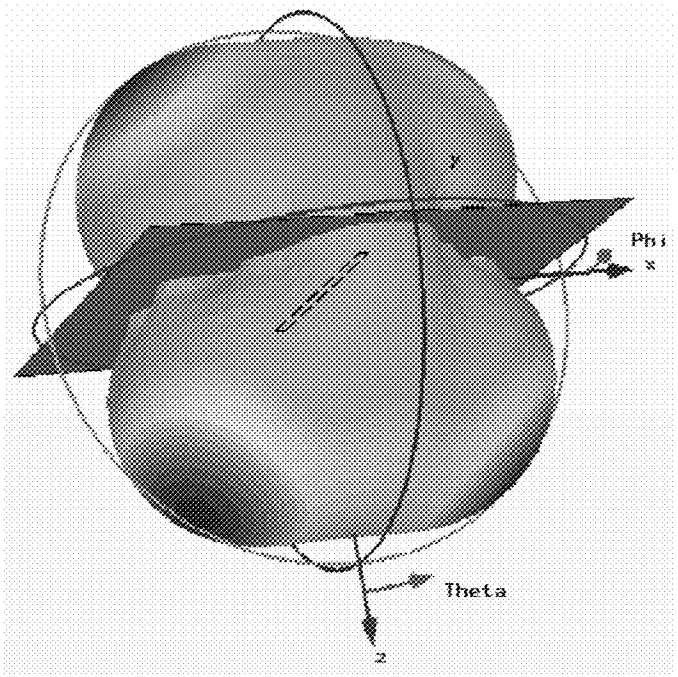

Referring to FIG. 3, extending the dimensions of the ground plane well beyond a wavelength of the resonant frequency of the slot antenna results in a radiation pattern having four peaking main lobes (showing for maximum gain) at an approximately 45 deg angle to the ground plane with a separation of approximately 90 deg between any two main lobes. Also, as we approach the normal to the ground plane the antenna gain drops and is close to a standard dipole antenna gain (approx. 2.15 dBi) at bore sight along axis z.

FIG. 3 also shows a plot of the return loss and gain of the antenna. As shown, this antenna configuration produces a flat gain response across 830 MHz to 980 MHz. The return loss and the gain include specific data points at 902 MHz, 915 MHz, and 928 MHz. These frequencies are common frequencies used in RFID applications. Numerous RF simulations were run and physical RF mockups were built, and the testing validates the concepts associated with the antenna apparatus of the present invention. Gain, return loss, and radiation pattern were all confirmed. In particular, within the desired frequency ranges the achieved gain is better than 5 dB.

The addition of a reflector, similar in size to the ground plane, placed behind the slot antenna and having a parallel spacing to the ground plane would help to reflect back most of the RF energy, making the extended ground plane configuration a high gain antenna system. The reflector is a conductive plate with dimensions similar to the extended ground plane and is located behind the ground plane (e.g. above the ground plane in a ceiling mount configuration). The reflector takes energy that is directed upward towards it and redirects it combining it with the directly radiated pattern that was already directed downward. The result is a high gain, directional antenna.

Figure 4:
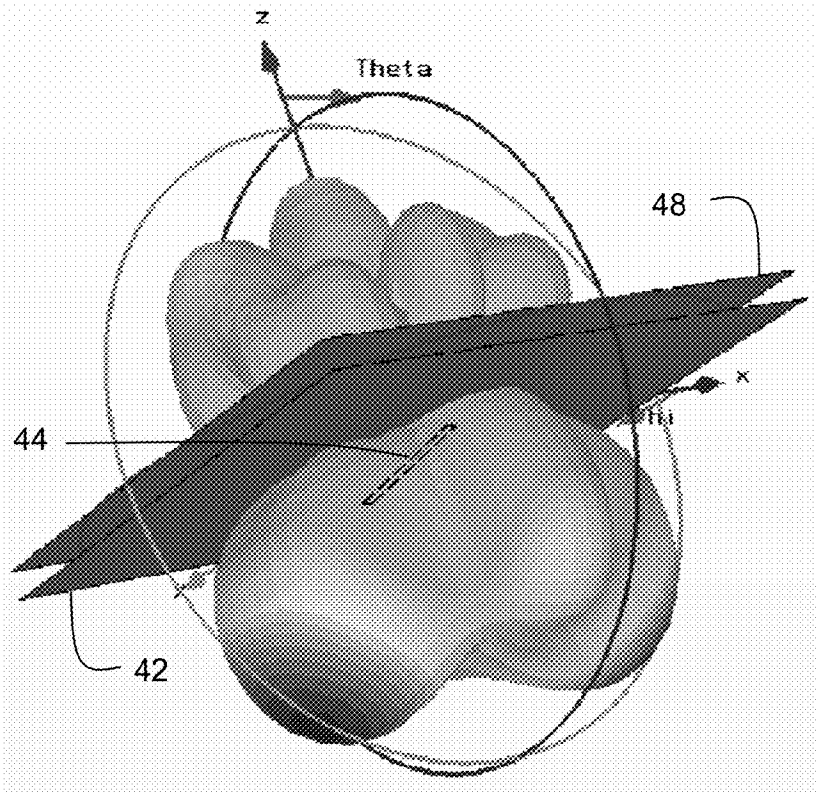
FIG. 4 provides perspective views of an extended ground plane RFID slot antenna with reflector and an associated three-dimensional plot of its radiation pattern, in accordance with some embodiments of the present invention.
Figure 4:
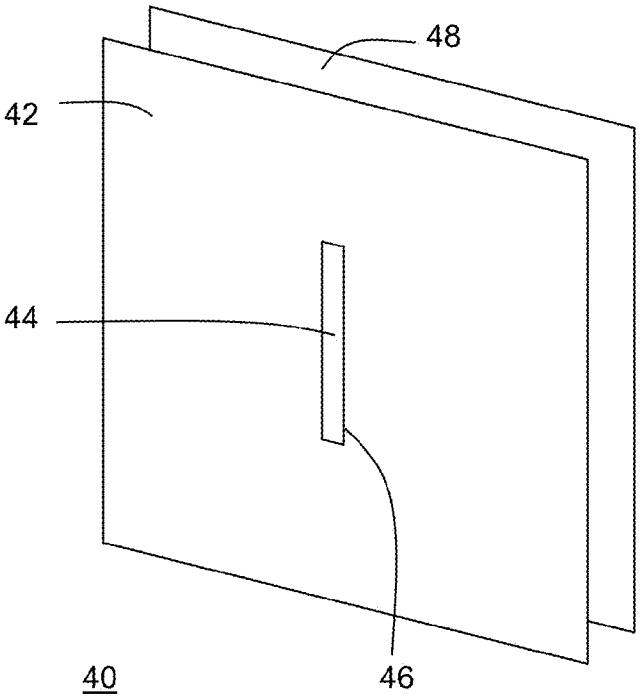

Accordingly, in an exemplary embodiment of the present invention, as shown in FIG. 4, the antenna apparatus 40 of the present invention includes an extended ground plane 42 with an aperture or slot 44 with a feed 46 and a reflector 48 backing the slot antenna substantially parallel to the ground plane 42 and configured to reflect radio frequency energy from the slot antenna. The slot antenna and the reflector cooperatively form a high-gain reflector-backed RFID slot antenna apparatus. Moreover, the ground plane and reflector provide a radial-mode waveguide effect around the periphery of the apparatus that provides RFID read coverage approaching a cosecant-squared radiation pattern.

Figure 5:
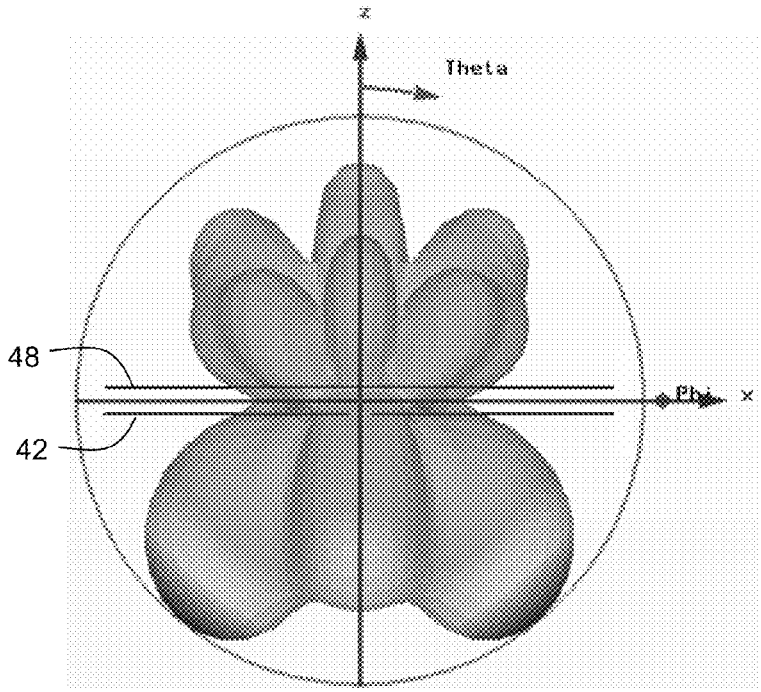
FIG. 5 is a cross-sectional view of the antenna of FIG. 4 and an associated three-dimensional plot of its radiation pattern, along with a graphical representation of its resulting inverted mirrored cosecant-squared radiation pattern.
Figure 5:
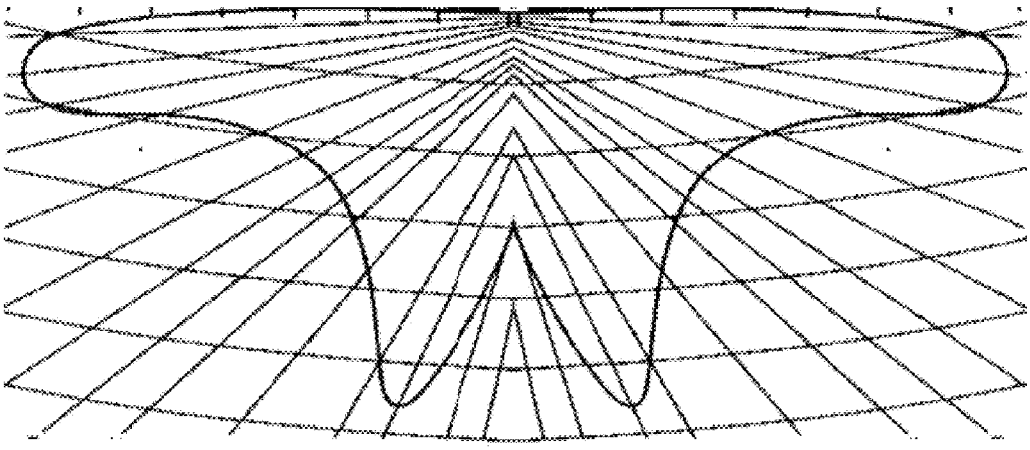

In particular, as shown in the side view of FIG. 5, the antenna apparatus of the present invention provides a substantially cosecant-squared inverted and mirrored radiation pattern by extending the typically external dimensions of the ground plane of a typical slot antenna to well beyond one wavelength of the resonant frequency of the slot antenna, and preferably at least one and half wavelengths. The additional reflector has external dimensions substantially the same as the ground plane and is spaced from the ground plane approximately one inch to provide the cosecant-squared radiation pattern. In the example presented herein, the slot configuration produces a resonant frequency of approximately 915 MHz, which is a standard frequency for RFID applications. It should be noted that the antenna and the reflector are illustrated herein in a substantially square shape, but those of ordinary skill in the art will recognize other shapes are also contemplated.

In the example described herein, the ground plane and reflector of the present invention are configured as square, electrically conductive plates with each side having a length of approximately one and half wavelengths, 3 $\lambda/2$ (e.g. approximately twenty inches for a 915 MHz antenna). The slot of the ground plane has dimensions of $\lambda/2$ in length by $\lambda/12$ in width (e.g. approximately six inches by one inch). The ground plane and reflector are substantially parallel to each other and are spaced $\lambda/12$ apart (e.g. approximately one inch at 915 MHz). The presence of the reflector changes the total radiated pattern by launching additional peripheral signals by way of the radial waveguide mode, even though some of the reflected signals flow onto the ground plane.

In operation, the slot antenna will transmit four main lobes (as shown in FIG. 3). The two front lobes are transmitted downwardly. The two rear lobes are transmitted upwardly and are reflected by the reflector (as shown in FIG. 4). Some of this reflected RF energy passes through the slot and combines with the two front lobes that are transmitted downwardly (as shown in FIG. 4). This combination transmitted/reflected RF energy mainly produces the vertically downward lobe shown in FIG. 5, but also produces some horizontal energy. Some of the reflected energy from the reflector is also channeled outwardly between the plates of the ground plane and reflector, which effectively form a radial-mode waveguide. This reflected and channeled RF energy mainly produces the horizontally outward lobes shown in FIG. 5. The combination of all the transmitted and reflected energies results in an inverse, mirrored, cosecant-squared-like antenna radiation pattern. Advantageously, this configuration provides the ability to read tags that are farther away with higher gain while also being able to read closer in tags normally.

Figure 6:
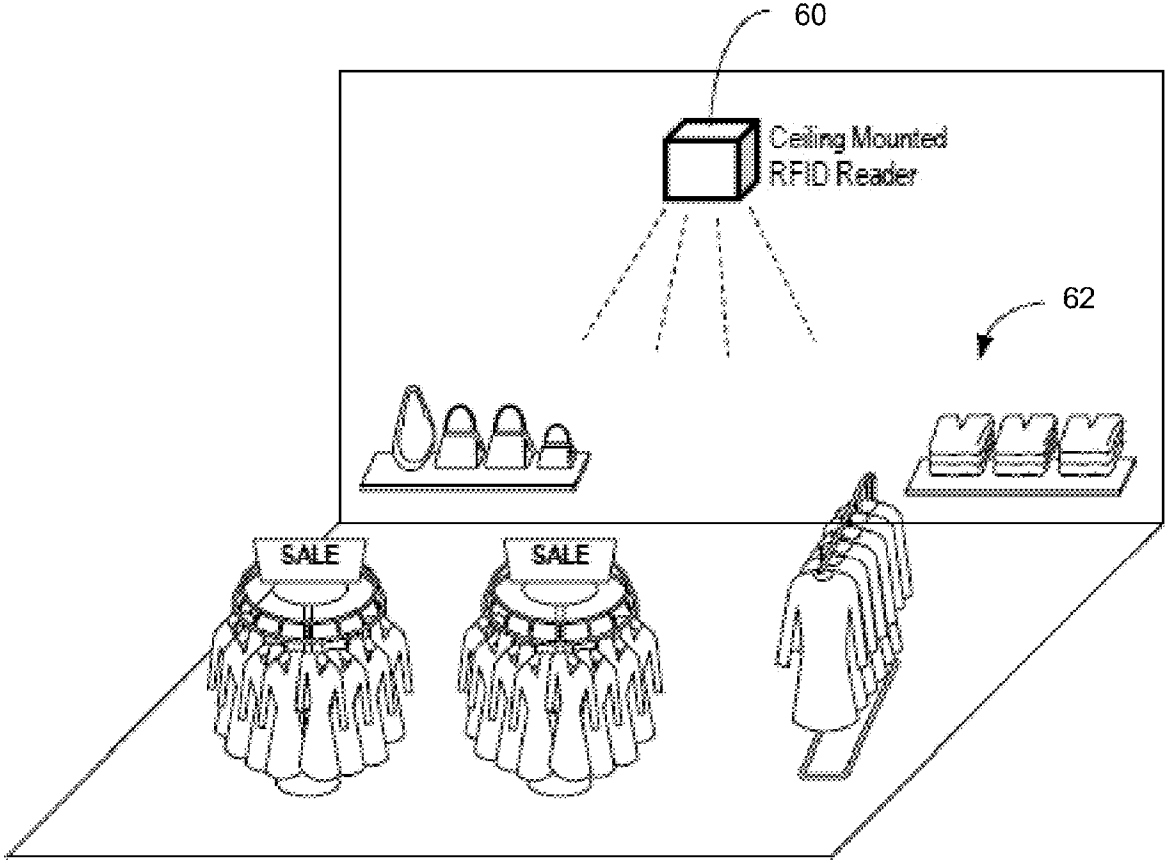
FIG. 6 is a perspective view of an environment utilizing the antenna of FIG. 4 coupled to an RFID reader, in accordance with some embodiments of the present invention.

FIG. 6 is a perspective diagram of an exemplary retail environment with an RFID reader 60 using the RFID antenna of the present invention in a ceiling-mounted overhead configuration, wherein the ground plane and reflector are substantially parallel to the floor. The RFID reader 60 is configured to wirelessly interrogate a plurality of RFID tags located on or affixed to a plurality of items 62. The RFID reader 60 may be mounted to a ceiling in the retail environment. The retail environment is shown solely for illustration purposes, and the RFID antenna may be used in any environment including warehouse, manufacturing facility, file room, storage area, and the like.

The RFID reader 60 of the present invention can further include a housing enclosing the antenna apparatus, wherein the housing includes the RFID reader disposed therein and communicatively coupled to the antenna apparatus by providing an RF feed thereto, along with associated electronics for providing RFID reader functionality. The housing may further include any of a camera and wireless communication access point, which may be located behind the reflector. The RFID reader including the antenna apparatus is configured to operate in an overhead configuration with respect to a plurality of RFID tags. The antenna apparatus is configured to provide an inverted and mirrored substantially cosecant-squared far field radiation pattern over the floor of the environment.

In general, the RFID reader is configured to provide communication between the RFID reader and RFID tags. For example, the RFID reader "interrogates" RFID tags, and receives signals back from the tags in response to the interrogation. The reader is sometimes termed as "reader interrogator" or simply "interrogator". In an exemplary embodiment, the RFID reader may include, without limitation one or more of: a processor, a communication module, memory, a camera, and the antenna apparatus (40 of FIG. 4). The elements of the RFID reader may be interconnected together using a communication bus or another suitable interconnection arrangement that facilitates communication between the various elements of RFID reader. It should be appreciated that the above description depicts the RFID reader in an oversimplified manner and a practical embodiment can include additional components and suitably configured processing logic to support known or conventional operating features that are not described in detail herein for the sake of brevity.

The RFID reader is controlled by one or more processors to interrogate the RFID tags of the items. The housing can further include electronics and RF components for operation of the antenna apparatus. For example, the electronics and components may include electrical connectivity to the slot antenna feed for transmission and reception of radio frequency signals. The housing may further include electronics and the like for operation of the RFID reader as well as other components as described herein. The housing may be attached or disposed to the reflector. Alternatively, the electronics, components, etc. may be disposed or located behind the reflector within the housing.

The processor may be any microprocessor, application specific integrated circuit (ASIC), field programmable gate array (FPGA), digital signal processor (DSP), any suitable programmable logic device, discrete gate or transistor logic, discrete hardware components, or combinations thereof that has the computing power capable of managing the RFID reader 10. The processor generally provides the software, firmware, processing logic, and/or other components of the RFID reader 10 that enable functionality of the RFID reader.

The RFID reader can also include a communication module including components enabling the RFID reader to communicate on a wired or wireless network. For example, the communication module may include an Ethernet interface to communicate on a local area network. The communication module can be compliant to IEEE 802.11 and variants thereof). Additionally, the RFID reader may include other wireless technologies such as, but are not limited to: RF; IrDA (infrared); Bluetooth; ZigBee (and other variants of the IEEE 802.15 protocol); IEEE 802.11 (any variation); IEEE 802.16 (WiMAX or any other variation); Universal Mobile Telecommunications System (UMTS); Code Division Multiple Access (CDMA) including all variants; Global System for Mobile Communications (GSM) and all variants; Time division multiple access (TDMA) and all variants; Direct Sequence Spread Spectrum; Frequency Hopping Spread Spectrum; wireless/cordless telecommunication protocols; wireless home network communication protocols; paging network protocols; magnetic induction; satellite data communication protocols; wireless hospital or health care facility network protocols such as those operating in the WMTS bands; GPRS; and proprietary wireless data communication protocols such as variants of Wireless USB.

The RFID reader can also include a memory including any of volatile memory elements (e.g., random access memory (RAM, such as DRAM, SRAM, SDRAM, etc.)), nonvolatile memory elements (e.g., ROM, hard drive, tape, CDROM, etc.), and combinations thereof. Moreover, the memory can incorporate electronic, magnetic, optical, and/or other types of storage media. Note that the memory can have a distributed architecture, where various components are situated remotely from one another, but can be accessed by the processor. The memory may be utilized to store data associated with RFID interrogations, the camera, etc. The camera may include any device for capturing video, audio, photographs, etc.

Figure 7:
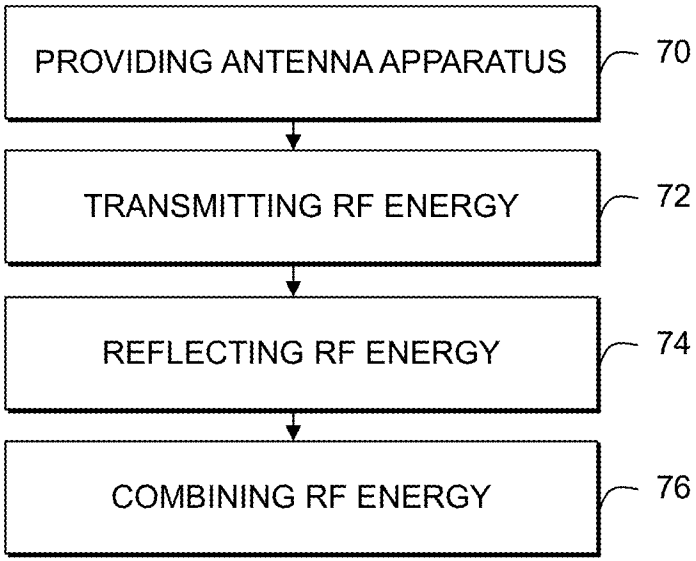
FIG. 7 shows a flowchart of a method in accordance with some embodiments of the present invention.

Referring to FIG. 7, the present invention describes a method for providing an antenna radiation pattern. A first step 70 includes providing an antenna apparatus. This step includes providing a ground plane having a square or round configuration with external dimensions of at least one, and preferably at least one and half wavelengths of a resonant frequency of the slot antenna. This step also includes providing a reflector having a square or round configuration with external dimensions substantially the same as the ground plane. The reflector is substantially parallel to the ground plane and is spaced approximately one-inch from the ground plane. Optionally, this step includes providing a Radio Frequency Identification (RFID) reader communicatively coupled to the antenna apparatus within a housing, wherein the housing is ceiling-mounted in an RFID read environment, and wherein the ground plane of the antenna apparatus is substantially parallel to the floor of the environment.

A next step 72 includes transmitting radio frequency energy by a slot antenna configured within the ground plane.

A next step 74 includes reflecting with the reflector the radio frequency energy transmitted by the slot antenna.

A next step 76 includes cooperatively combining the reflected radio frequency energy with the transmitted radio frequency energy via the slot antenna and via a radial mode waveguide formed by the ground plane and reflector to provide an inverse, mirrored, substantially cosecant-squared radiation pattern.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An antenna apparatus, comprising:

a slot antenna configured within a ground plane;

a radio frequency signal feed coupled to the slot antenna proximal to one end of the slot antenna; and a conductive reflector backing the slot antenna and configured to reflect radio frequency energy;

wherein the slot antenna, ground plane, and the reflector are rectangular and cooperatively form a reflector-backed slot antenna and a waveguide formed between the plates of the ground plane and reflector that uses the presence of the reflector to change a total radiated pattern of the apparatus by launching additional peripheral signals around a periphery of the apparatus to provide an antenna radiation pattern of an inverse, mirrored, cosecant-squared radiation pattern.

2. The antenna apparatus of claim 1, wherein the ground plane is configured with external dimensions of at least one wavelength of a resonant frequency of the slot antenna.

3. The antenna apparatus of claim 1, wherein the ground plane is configured with external dimensions of one and half wavelengths of a resonant frequency of the slot antenna.

4. The antenna apparatus of claim 1, wherein the reflector is configured with external dimensions the same as the ground plane.

5. The antenna apparatus of claim 1, wherein the reflector is parallel to the ground plane and is spaced one-twelfth wavelength from the ground plane.

6. The antenna apparatus of claim 1, further comprising:

a Radio Frequency Identification (RFID) reader communicatively coupled to the antenna apparatus within a housing, wherein the housing is ceiling-mounted in an RFID read environment, and wherein the ground plane of the antenna apparatus is parallel to the floor of the environment.

7. A Radio Frequency Identification (RFID) reader, comprising:

a housing;

an RFID reader disposed within the housing; and an antenna apparatus disposed within the housing and communicatively coupled to the RFID reader, wherein the antenna apparatus comprises:

a slot antenna configured within a ground plane;

a radio frequency signal feed coupled between the RFID reader and the slot antenna proximal to one end of the slot antenna; and a conductive reflector backing the slot antenna and configured to reflect RF energy;

wherein the slot antenna, ground plane, and the reflector are rectangular and cooperatively form a reflector-backed slot antenna and a waveguide formed between the plates of the ground plane and reflector that uses the presence of the reflector to change a total radiated pattern of the apparatus by launching additional peripheral signals around a periphery of the apparatus to provide an antenna radiation pattern to provide an antenna radiation pattern of an inverse, mirrored, cosecant-squared radiation pattern.

8. A method for providing an antenna radiation pattern, the method comprising the steps of:

transmitting radio frequency energy by a rectangular slot antenna configured within a rectangular ground plane and a radio frequency signal feed coupled to the slot antenna proximal to one end of the slot antenna;

reflecting with a rectangular reflector the radio frequency energy transmitted by the slot antenna; and cooperatively combining the reflected radio frequency energy with the transmitted radio frequency energy via the slot antenna and via a waveguide formed between the ground plane and reflector that uses the presence of the reflector to change a total radiated pattern by launching additional peripheral signals around a periphery of the ground plane and reflector to provide an antenna radiation pattern of an inverse, mirrored, cosecant-squared radiation pattern.

9. The method of claim 8, further comprising providing a ground plane having a configuration with external dimensions of at least one wavelength of a resonant frequency of the slot antenna.

10. The method of claim 8, further comprising providing a ground plane having a configuration with external dimensions of one and half wavelengths of a resonant frequency of the slot antenna.

11. The method of claim 8, further comprising providing a reflector having a configuration with external dimensions the same as the ground plane.

12. The method of claim 8, further comprising providing a reflector parallel to the ground plane and is spaced one-twelfth wavelength from the ground plane.

13. The method of claim 8, further comprising providing a Radio Frequency Identification (RFID) reader communicatively coupled to an antenna apparatus within a housing, wherein the housing is ceiling-mounted in an RFID read environment, and wherein the ground plane of the antenna apparatus is parallel to the floor of the environment.

* * * * *